US005120553A

United States Patent [19]

Kupcikevicius

[11] Patent Number: 5,120,553

[45] Date of Patent: Jun. 9, 1992

[54] SHRINK BAG WITH INTEGRAL HANDLE

[75] Inventor: Vytautas Kupcikevicius, Oaklawn, Ill.

[73] Assignee: Viskase Corporation, Chicago, Ill.

[21] Appl. No.: 577,702

[22] Filed: Sep. 5, 1990

[51] Int. Cl.[5] ..... B65D 65/00

[52] U.S. Cl. ..... 426/129; 53/442; 206/497; 383/10; 426/412

[58] Field of Search ..... 426/129, 412, 410, 413, 426/110; 383/10, 6, 7, 907; 53/413, 441, 442; 206/497, 524.8

[56] References Cited

U.S. PATENT DOCUMENTS

| | | | |
|---|---|---|---|
| Re. 32,065 | 1/1986 | Ralston, Jr. et al. | 604/408 |
| 43,567 | 7/1864 | Campbell | 383/10 |
| 2,664,358 | 12/1953 | Eichler | 426/124 |
| 3,441,198 | 4/1969 | Ericson | 426/129 |
| 3,516,537 | 6/1970 | Dreyfus et al. | 206/632 |
| 4,244,408 | 1/1981 | Shoda | 150/12 |
| 4,247,005 | 1/1981 | Buxton | 206/525 |
| 4,277,859 | 7/1981 | Seaman | 5/434 |
| 4,549,877 | 10/1985 | Lehmacher | 156/510 |
| 4,555,025 | 11/1985 | Weinberg et al. | 206/497 |
| 4,764,028 | 8/1988 | Wood et al. | 383/20 |
| 4,765,381 | 8/1988 | Castle | 150/52 R |
| 4,785,934 | 11/1988 | Hogle | 206/315.11 |
| 4,958,735 | 9/1990 | Odabashian | 206/497 |

*Primary Examiner*—Donald E. Czaja
*Assistant Examiner*—Anthony Weier
*Attorney, Agent, or Firm*—Roger Aceto

[57] ABSTRACT

A shrink bag having one end heat sealed to form the closed end of a bag pocket and including a skirt portion at this closed end which forms a handle upon heat shrinking the bag about a food product. The bag is particularly adapted for packaging whole turkeys and the like and, to this end, the heat seal is configured so the bag pocket closed end is a deep cavity shaped to accommodate the tail end of the turkey.

24 Claims, 2 Drawing Sheets

SHRINK BAG WITH INTEGRAL HANDLE

FIELD OF THE INVENTION

The present invention relates generally to shrink bags as may be used for packaging food products and more specifically to a heat shrinkable bag having an integral carrying handle.

BACKGROUND OF THE INVENTION

It is customary for food processors to vacuum package bulky food articles such as whole muscle meat products, brick cheese and poultry in shrink bags. The processor loads the food article into the bag and evacuates the bag to collapse it about the food product. The bag is sealed while in its evacuated condition by gathering the open end and applying a metal clip or by heat sealing. The sealed bag then is passed through a hot water bath or hot air tunnel to shrink the sealed bag about the food product. Shrinking the bag in this fashion closely conforms the bag to the contour of the food product thereby making an attractive, generally wrinkle-free package.

Poultry items such as turkeys and other whole birds present several problems for this type of packaging. For example, the poultry carcass is generally the shape of a tear drop having a broad rounded breast portion tapering to the tail of the bird. The tear drop shape is accentuated by the customary practice of folding the legs of the bird close to the body and binding the end of the legs to the tail of the bird. This tear drop shape does not lend itself to formation of a substantially wrinkle free package even when using shrink film.

A bag fabricated to accommodate a whole bird, generally has front and rear panels composed of a heat shrinkable plastic film which are heat sealed together at the closed end of the bag. It is common to have the closed end of the bag convex to accommodate the broad rounded breast of the bird. The opposite open end of the bag must be wide enough to receive the bird which is inserted breast first into the bag. If the wide bag opening is stretched to a flat width and heat sealed straight across the bag, a considerable amount of unfilled bag material remains extended across the tail of the bird. On heat shrinking, only a portion of this material conforms to the tapered contour of the bird whereas the remainder forms an unattractive flange which increases in width towards the tail of the bird.

One approach for avoiding the formation of this flange is to gather the open end of the bag about the tail of the bird and close the gathered opening with a metal clip. This procedure pulls the bag close to and along the more tapered parts of the bird. Heat shrinking the pulled and gathered bag material generates creases and folds which radiate out from under the clip for some distance along the body of the bird. While this generally provides a more asthethically pleasing appearance than the flange caused by heat sealing, these creases and folds often truncate any design or identification printed on the bag and are objectionable. Accordingly, an even smoother, crease and fold-free appearance with the bag stretched taut over the legs and tail of the bird is preferred.

Another problem related to packaging turkeys and the like in shrink bags is that the resulting packaged product is bulky, relatively heavy, usually frozen, and difficult to manually grasp and lift. Therefore it is desirable to provide a carrying handle to facilitate handling the vacuum packaged product. For this purpose a separate handle is attached to the packaged product at the clip closure or the product is inserted into a netting which is gathered and clipped to provide a carrying handle. Both arrangements add to the packaging costs.

Preferably, the handle should be formed integral with the bag to avoid the added expense and processing steps of attaching a handle to the packaged product. For poultry packaging, a handle located at the tail of the bird is preferred as this leaves the package over the breast area of the bird free to receive printed information such as a decorative design, corporate logo or other identifying product information. Also, a handle at the tail of the bird provides a desirable weight distribution in that the heavier breast portion of the bird is carried below the lighter tail portion.

U.S. Pat. No. 4,555,025 discloses a shrink bag having an integral handle forming portion. The bag is a so called "extended lip bag" wherein one bag panel extends beyond the bag open end. As disclosed in this patent, the handle is formed in the extended lip portion by punching a hot die through the lip to provide an opening having a fused bead extending continuously about the opening. Formation of the opening in the lip is essential because inserting the hot die through the bag at any other location will fuse the bag panels together thereby partly occluding the bag. Upon heat shrinking, the extended lip thickens and forms a handle which protrudes longitudinally from the resulting package.

Accordingly, an object of the present invention is to provide a shrink bag having an integral handle.

Another object is to provide a shrink bag having an integral handle positioned so as not to occlude any portion of the bag opening.

Yet another object of the present invention is to provide a shrink bag with an integral carrying handle wherein the bag is especially adapted for packaging whole body poultry such as turkeys and the like.

A further object of the present invention is to provide a shrink bag having an integral handle portion located at the end of the bag opposite its open end.

A still further object is to provide a shrink bag having an integral handle which lies close to the surface of the resulting package.

SUMMARY OF THE INVENTION

A shrink bag according to the present invention has an open end for loading a product into the bag and a closed end wherein a handle forming portion of the bag is adjacent the closed end. The bag of the present invention is particularly adapted for use in packaging whole body poultry such as turkeys and the like. For this reason the bag is described in reference to a preferred packaging use as a turkey or a whole body poultry bag.

To facilitate its use as a turkey bag, the shrink bag of the present invention has a closed end formed to receive the tapered configuration of the tail portion of the bird. The closed end of the bag preferably is formed by heat sealing wherein the heat seal is generally concave across the bag to form a deep bag pocket for receiving the tapered tail end to the bird. A skirt portion extending from this heat seal contains a slit which forms a handle opening.

Thus, the bag handle is formed from portion of the material of the skirt at the closed end of the bag and to a large extent is formed of the excess bag material heretofore pulled or gathered around the tail to prepare the bag for a clip closure. With this preferred arrangement the bird is loaded tail first through the bag opening. The bag is evacuated and then the bag opening is then closed, preferably by stretching it to a flat width and heat sealing around the breast of the bird. Closing the bag about the breast of the bird in this fashion requires significantly less gathering than if the bag is closed about the tail. On subsequent heat shrinking, the resulting flange of bag material around the breast of the bird is considerably reduced from the flange created when heat sealing straight across the bag at the tail end of the bird.

Also, the bag is formed to accommodate the tapered, tear drop-shaped configuration of the tail end of the bird so the area of bag material subject to heat shrinking about the tail is reduced. The result, on heat shrinking, is a more asthethically appealing package in that the bag material around the entire bird is smooth, taut and substantially wrinkle free.

Moreover, heat shrinking causes the skirt portion at the closed end of the bag to draw over the resulting package so the handle formed from the skirt lies close to the package surface. This produces a handle which is unobtrusive and yet is easily grasped for manually lifting the package.

In particular, the present invention is characterized in one aspect thereof by a heat shrinkable bag comprising:

a) congruent front and rear panels of a thermoplastic heat shrinkable material defining the front and rear of a bag pocket, the panels being joined leak-tight along side edges and having common ends including a first end and an opposite open end;

b) a continuous transverse heat seal connecting said front and rear panels adjacent to but spaced from said first end, said heat seal defining the closed bottom of said bag pocket for containing an article to be packaged which is inserted into said bag through said opposite open end;

c) a skirt defined by said front and rear panels between said first end and said heat seal at the closed bottom of said bag pocket opposite said open end; and d) said skirt having a transverse slit opening through said panels and including a portion between said slit and said first end which upon evacuation, sealing and heat shrinking said bag containing a said article forms a handle portion for gripping and for carrying said article-containing bag.

DETAILED DESCRIPTION OF THE INVENTION

Figure 1:
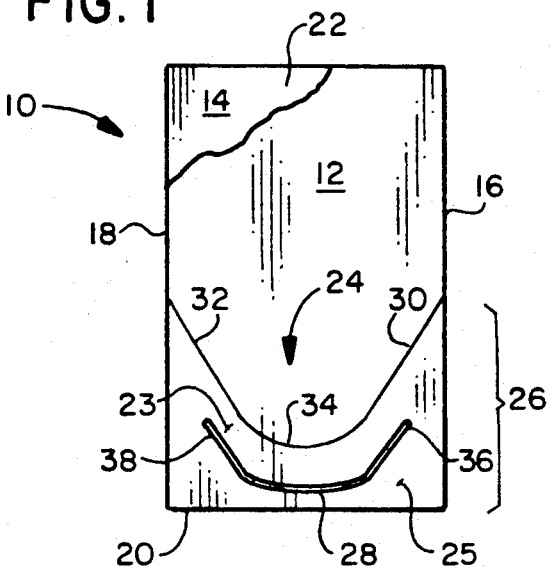
FIG. 1 is a plan view of a bag according to the present invention unfilled and prior to heat shrinking.

Referring to the drawings, FIG. 1 shows a bag of the present invention generally indicated at 10 in its lay-flat condition prior to its packaging use. The bag is made of any suitable heat shrinkable thermoplastic packaging film commonly used for vacuum packaging food products. A suitable film is an oriented heat shrinkable film as disclosed for example in U.S. Pat. No. 4,863,769.

Generally, such films are formed as blown tubes. The tube is collapsed to a lay-flat condition to provide superimposed front and rear bag panels having seamless side edges. The laid-flat tube is then heat-sealed across its width to form a closed bag end and then it is severed at a location spaced from the heat seal to provide an open bag end.

In accordance with this practice, FIG. 1 shows the bag 10 to have superimposed front and rear panels 12 and 14 respectively. The front and rear panels are congruent and lay flat one against the other.

The panels are joined along lateral side edges 16, 18. If the bag is made of a collapsed tube as noted above, the side edges 16, 18 are seamless. Otherwise one or both side edges 16, 18 contain a seam such as is formed by heat sealing or an adhesive for connecting the panels.

The congruent bag panels 12, 14 have common ends 20 and 22 wherein end 22 is the open end of the bag. The panels at end 20 are optionally connected such as by heat sealing the panels together.

The front and rear panels 12, 14 are connected by a heat seal generally indicated at 24 which extends across the bag inboard of the end 20. This heat seal 24 defines the closed bottom of a bag pocket for containing an article to be packaged which is inserted into the bag through the open end 22. The sides of the bag pocket are formed by bag panels 12, 14.

The heat seal 24 forming the bottom of a bag pocket may extend straight across the bag. Preferably the heat seal is shaped to conform generally with an end of an article to be inserted into the bag pocket and against the bottom of the bag. In one embodiment of the bag for use in packaging whole poultry, the heat seal provides a deep cavity shape able to accommodate the tapered configuration of the tail end of a bird such as a turkey or the like.

In this respect, FIG. 1 shows that the heat seal 24 has generally linear side portions 30, 32 which extend from each side edge 16, 18 respectively and angle inward toward the longitudinal axis of the bag in the direction away from the open end 22. These two side portions 30, 32 converge toward each other and merge with an arcuate transverse base portion 34 so there is a smooth continuous transition from one angled side portion 30, 32 to the other. The result is that the closed bottom of a bag pocket as defined by heat seal 24 provides a deep concave pocket able to accommodate the tail end portion of a turkey or the like when the bag is open from its lay-flat condition.

The portion of the bag panels 12, 14 between heat seal 24 and end 20 defines a skirt 26 at the end of the bag opposite open end 22. The skirt includes the bag end 20 and contains a generally centrally oriented slit 28. The slit can be formed by any suitable means which cuts through both bag panels. Preferably the slit is formed by a hot knife which burns through the bag panels and in the process welds the panels together at the slit margins. As described hereinbelow, the slit forms an opening to facilitate use of the skirt as a bag handle for carrying an article sealed within the bag.

The placement and configuration of the slit is important to a proper functioning of the skirt as a bag handle. For example, the ends 36, 38 of the slit should be angled towards the bag side edges 16, 18 in the direction of the bag opening 22. This will help to avoid stress concentrations at the end of the slit that might cause the skirt to tear when lifting an article sealed in the bag. The distance between the slit and the heat seal 24 in the region indicated at 23 must be sufficient to avoid the propagation of stress concentration into the heat seal 24 which might cause the heat seal to tear. Also, the distance between the slit and the end 20 of the bag in the region indicated at 25 must be sufficient to provide a handle to support the product packaged within the bag. The adjustment of these parameters to provide an appropriate configuration and location for the slit in order to provide a handle able to support the weight of the packaged product is well within the skill of the art.

Figure 2:
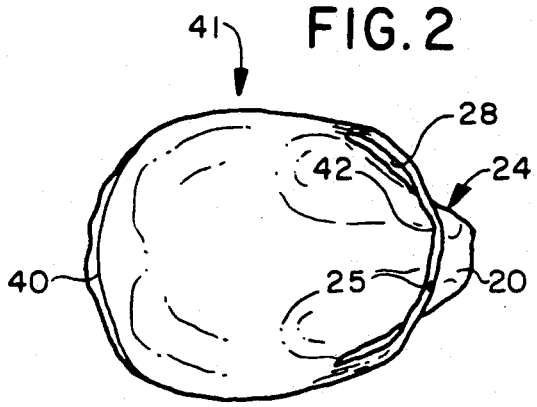
FIGS. 2 and 3 are plan and elevation views respectively showing a package comprising the bag of FIG. 1 containing a whole body poultry and after heat shrinking.

FIG. 2 shows a package generally indicated at 41 formed using the bag of FIG. 1. To this end a bird such as a turkey or the like is loaded tail first into the bag of FIG. 1 through its open end 22. The tail portion of the bird generally fits and is received into the concave bottom of the bag pocket defined by heat seal 24. Next the bag is evacuated and the open end of the bag is stretched to a flat width and is sealed, preferably by a heat seal 40, as shown in FIG. 2, around the breast portion of the bird. The sealed bag is then immersed in hot water or otherwise heated to shrink the bag about the bird (or other product) contained within the bag.

On heat shrinking, the bag material becomes tight to the bird to provide a smooth generally wrinkle-free package. In this respect, wrinkles or other stretch lines at the tail end portion of the bird are eliminated since the deep cavity of the bag pocket provided by the contour of heat seal 24 conforms to the shape of the tail end portion. Thus, any printing on the bag is not obscured or truncated by creases and folds otherwise produced if the bag open end is gathered around the tail end of the bird.

Figure 3:
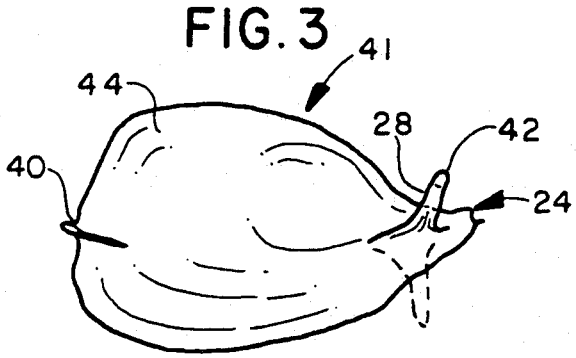

Also, on heat shrinking, the portion 25 (FIG. 1) of the skirt material between the slit 28 and bag end 20 shrinks and pulls away from the slit. However, the shrink of the skirt material 23 between the slit and heat seal 24 is restrained somewhat by the product within the bag. The result as shown in FIG. 2, is that the skirt portion 25 of FIG. 1 shrinks inward towards heat seal 24 and draws over and across the bag pocket formed by the congruent panels 12, 14. As shown in FIGS. 2 and 3, this forms the skirt portion 25 of FIG. 1, to a bag handle 42 which extends over and across the resulting bag package 41 adjacent the bottom of the bag pocket as defined by heat seal 24. The handle may extend and locate either over the top of the bag package 41 as shown in solid line (FIGS. 2 and 3) or it can extend and locate across the back of the package as shown in dotted line in FIG. 3. If the skirt portion 25 does not initially shrink and draw to a desired location (front or back of package 41), it is easily stretched and pulled over the end of the package (now defined by heat seal 24) to a desired position (front or back).

Figure 4:
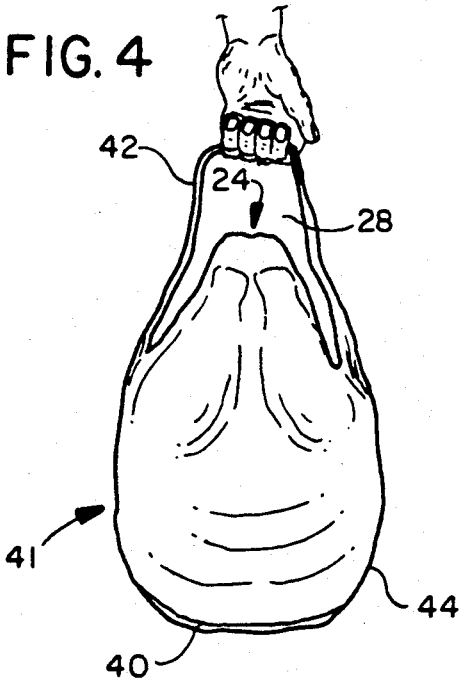
FIG. 4 shows the package of FIG. 2 in a carrying position.

While the handle 42 lies close to the surface of the package, slit 28 provides sufficient clearance between the handle and the surface of the package 41 to permit the insertion of one's hand to grasp the handle. Subsequently, when the handle is gripped and the package lifted, the handle will stretch from the package as shown in FIG. 4. However, prior to gripping and lifting, the handle is located substantially within the general perimeter of the package. This facilitates locating the handle when a plurality of the packages are heaped together as in a frozen foods case.

The heat shrunk bag package 41 as shown in FIGS. 2–4 is preferred for poultry such as turkeys and the like. In this respect, the handle 42 is located at the tail of the bird which provides a desirable weight distribution when lifting and handling the bag package in that the heavier breast portion 44 is lowermost. Also, the broad area of the bag around the breast of the bird, as indicated at 44, is unobstructed and available for receiving printed matter.

Figure 5:
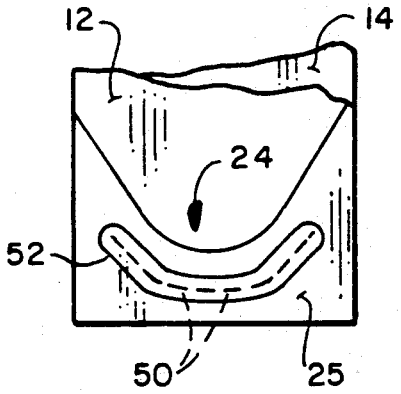
FIGS. 5–8 are views similar to FIG. 1 only showing alternate bag embodiments.

In the bag of FIG. 1, the slit 28 is continuous from end-to-end. As a result, the portion 25 of the skirt between the slit 28 and bag end 20 is unconnected and loose from the rest of the skirt and the bag. This loose, unconnected portion of the skirt can flip and flap about which may interfere with the automatic or manual handling of the bag. Accordingly, in order to maintain this skirt portion 25 associated with the bag, FIG. 5 shows another embodiment having the bag handle forming slit in the form of perforations 50. These perforations weaken the connection of the skirt portion 25 to the bag but maintains a connection so the skirt portion 25 remains associated with the bag. Preferably, the spacing of the perforations 50 is such that upon heat shrinking, the shrink induced stresses are sufficient to separate the skirt portion 25 by tearing along the line of the perforations. Otherwise, the separation can be accomplished by manually tearing along the line of perforations.

To insure that any tear propagation does not exceed the line of the perforations 50, FIG. 5 shows a heat seal 52 which connects the front and rear panels 12, 14 and circumscribes the line of perforations 50. As an alternative, the heat seal 52 adjoining the front and rear panels can have a width sufficient to accommodate the line of perforations 50 so these perforations are made in the heat sealed material.

Figure 6:
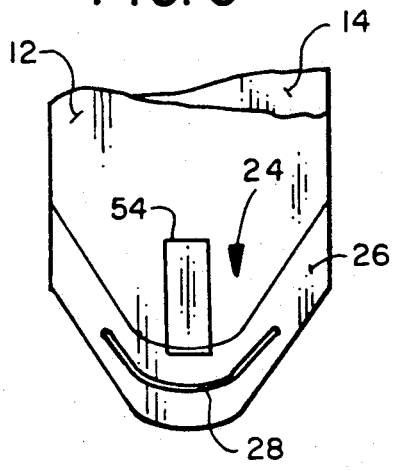

For retail purposes, it often is desirable to attach a tag to the bagged produce on which is written the weight, cost or other relevant information regarding the product. Generally, this tag is attached after packaging. However, in another embodiment of the present invention provision is made for the attachment of a tag during the bag manufacturing process. FIG. 6 shows one embodiment wherein a tag 54 is attached to the bag pocket forming heat seal 24. The tag preferably is of a heat sealable plastic film which has little or no heat shrink properties. This allows the entire area of the as-attached tag to be used for later-applied information such as the weight and price of the product contained in the shrink bag package. A suitable plastic film for this purpose has been found to be a sheet of spun bonded linear polyethylene fiber as sold by DuPont under the brand name TYVEK.

Preferably, the tag should be oriented so it overlaps a bag pocket forming portion of the front and rear panels 12, 14 and does not overlay the skirt portion 26. This is to avoid mistaking the tag for a handle because it is possible that if a bag containing a turkey is lifted by the tag the tag could tear out and break open the sealed package.

Figure 7:
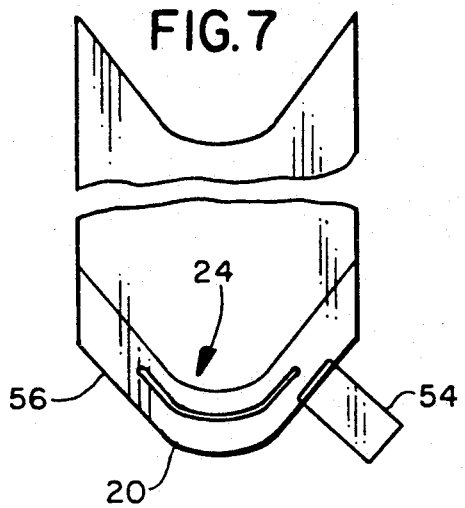

The tag 54 also can be located at the terminal end 20 of the bag in cases where this end is formed by heat sealing as shown in FIG. 7. In FIG. 7, a second heat seal 56 longitudinally spaced and generally parallel to heat seal 24 defines the end 20 of the bag and the tag 54 is attached to the bag by this second heat seal. As shown in FIG. 7, the tag 54 is positioned near a lateral side edge of the bag to minimize the possibility of mistaking the tag for a handle.

Figure 8:
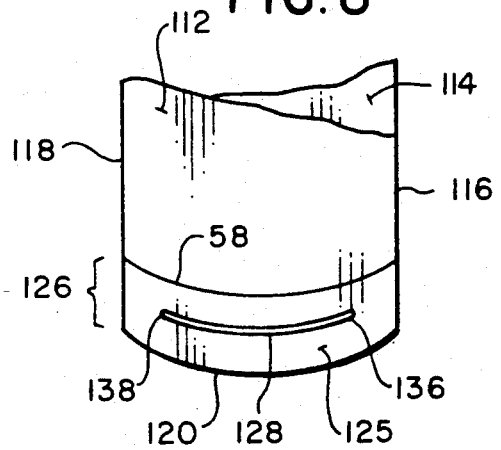

FIG. 8 illustrates another embodiment of the invention wherein the closed bottom of the bag pocket is formed by a heat seal 58 which is curved across the bag. This shape accommodates the rounded breast portion of a turkey or the like inserted breast first through the open bag end (not shown) opposite bottom 58. Adjacent the curved heat seal 58 is a skirt 126 formed by the portion of the congruent front and rear panels 112, 114 which extend from the heat seal to the end 120 of the bag. Skirt has a slit 128 which forms a bag handle opening. This slit is arcuate so it extends generally parallel with the heat seal 58 wherein the end portions 136, 138 of the slit are angled towards the lateral edges 116, 118 respectively. This shape acts to relieve stress concentrations at the ends of the slit so as to reduce the likelihood of tearing when lifting a heat shrunk bag containing a heavy bird or another food product.

Figure 9:
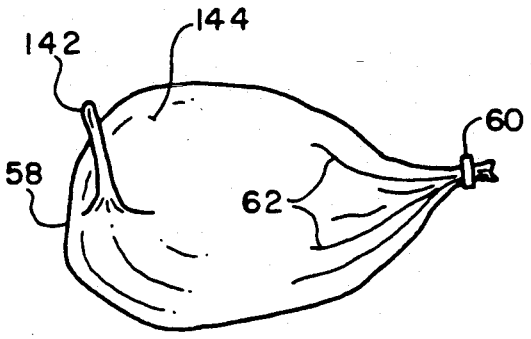
FIGS. 9 and 10 are plan and elevation views respectively showing a package comprising the bag of FIG. 7 containing a whole body poultry and after heat shrinking.

In use, the bird is inserted breast first into the bag of FIG. 6. After evacuation, the open end is either heat sealed across its flat width or, as shown in FIG. 9, the open end is gathered around the tail end of the bird and a metal clip 60 is applied to close the bag. In the case of packaging whole poultry, the heat shrunk package of FIG. 9 exhibits the crease and fold lines 62 caused by gathering an open end of the bag around the tail end of the bird and is less desirable than the package of FIGS. 2–4. The bag of FIG. 9 also locates the handle portion of the resulting package at the breast end 144 of the bird. While this too is less preferred, the bag of FIG. 9 nevertheless has its handle forming portion at the bottom of the bag pocket.

Figure 10:
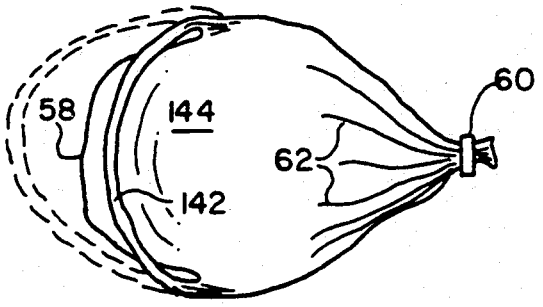

Upon heat shrinking, a skirt portion 125 (FIG. 8) shrinks inward and draws over the breast end 144 as shown in FIGS. 9 and 10 to form a handle 142. While this handle is drawn close to the surface of the resulting package, there is sufficient clearance to permit grasping the handle. When the handle is gripped and the package is lifted, the handle will stretch from the package as shown in dotted line in FIG. 9.

Having thus described the invention in detail, what is claimed as new is:

1. A heat shrinkable bag comprising:

a) congruent front and rear panels of a thermoplastic heat shrinkable material superimposed and laying flat one against the other and defining the front and rear of a bag pocket, the panels having longitudinal side edges joined fluid-tight to form bag pocket side edges and the panels having common ends including a first end adjacent but longitudinally spaced from a closed bottom of said bag pocket and an opposite open end;

b) a first continuous transverse heat seal connecting fluid tight said front and rear panels adjacent to but spaced from said first end, said first heat seal defining the closed bottom of said bag pocket;

c) a skirt formed solely from and defined by said congruent front and rear panels between said first end and said first transverse heat seal; and d) said skirt having a transverse slit opening through said panels and including a skirt portion between said slit and said first end which upon evacuation of said bag, sealing of said opposite open end and heat shrinking said bag about an article inserted into said bag, draws towards and at least to said transverse first heat seal and forms a bag integral carrying handle for gripping and carrying said article-containing bag.

2. A heat shrinkable bag as in claim 1 wherein a skirt portion between said slit and said first end, upon heat shrinking said bag about an article inserted into said bag, draws towards said transverse first heat seal and forms a bag handle extending over and across said bag pocket.

3. A heat shrinkable bag as in claim 1 having a second transverse heat seal connecting said panels at said first end and said skirt being defined between said first and second transverse heat seals.

4. A heat shrinkable bag as in claim 3 including a tag of heat sealable, non-heat shrinkable material attached to said bag at said first end by said second heat seal.

5. A heat shrinkable bag as in claim 1 including a tag of heat sealable, non-heat shrinkable material attached to said bag by said transverse heat seal.

6. A heat shrinkable bag as in claim 1 wherein said first continuous transverse heat seal extends in an arc across said bag to provide said bag pocket with a generally concave closed bottom and said slit is generally arcuate and parallel to said first continuous heat seal.

7. A heat shrinkable bag as in claim 1 wherein said slit has end portions extending at diverging angles toward each side edge of said bag in the direction of said open end to minimize stress concentrations at said slit end portions when lifting said bag after sealing an article within said bag pocket.

8. A heat sealable bag as in claim 1 wherein said slit is defined by a plurality of spaced perforations.

9. A heat sealable bag as in claim 9 wherein said panels are heat sealed together in an area adjacent and extending about said slit.

10. A bag for containing a poultry carcass comprising:

a) congruent front and rear panels of a heat shrinkable thermoplastic film having joined lateral edges, an open end and a closed end;

b) said closed end formed by longitudinally spaced first and second heat seals connecting said bag panels, each of said seals extending transverse said panels from one lateral side edge to another;

c) said first heat seal forming a generally concave pocket contoured to receive the generally tapered tail and leg portions of a poultry carcass inserted tail first through said open end;

d) said heat seals defining a skirt therebetween at the end of said bag opposite said open end, said skirt having a handle-forming opening therein for carrying said bag after heat shrinking about a poultry carcass sealed within said bag pocket; and e) a portion of said skirt between said handle-forming opening and second heat seal drawing towards said first heat seal and locating over said bag pocket responsive to heat shrinking said bag about a poultry carcass sealed in said bag pocket thereby providing a handle for carrying said bag when containing a poultry carcass.

11. A method of making a heat shrinkable bag having an integral carrying handle comprising:

a) providing congruent front and rear bag panels of a thermoplastic heat sealable material which are superimposed and lay flat one against the other said panels joined fluid tight along side edges to form sides of a bag pocket and having common ends including a first end and an opposite open end;

b) heat sealing said bag panels together adjacent to, but longitudinally spaced from, said first end thereby forming a continuous transverse heat seal which defines a fluid tight closed bottom of said bag pocket and a skirt formed solely from said congruent front and rear panels between said heat seal and said first end; and c) cutting a transverse slit through said congruent panels in said skirt between said bag pocket closed bottom and said first end with opposite end portions of said slit being turned in the direction of said open end, and said slit, upon heat shrinking said bag about a product sealed in said bag, forming a bag integral carrying handle opening adjacent said bag pocket closed bottom.

12. A method as in claim 11 wherein said heat sealing provides a fluid tight bag pocket closed bottom having:

a) linear side portions angled inward from each panel side edge in a direction away from said open end; and b) an arcuate transverse base portion forming a smooth transition from one angled portion to another whereby said heat sealing provides said bag with a relatively deep concave bag pocket upon opening said panels from said lay flat position.

13. A heat sealable bag as in claim 12 wherein said slit has end portions angled generally in the same direction as said heat seal linear side portions.

14. A method as in claim 13 including connecting said panels at said first end by heat sealing along a transverse line extending generally parallel to said bag pocket closed bottom.

15. A poultry carcass containing package comprising:

a) a poultry carcass including breast and tail portions inserted and vacuum packaged in a heat shrunk bag composed of congruent front and rear panels of a heat shrinkable thermoplastic film;

b) said bag having a transverse heat seal connecting said front and rear panels and forming a first closed end of a bag pocket, said heat seal being made prior to inserting said poultry carcass into said bag and said heat seal being contoured to accommodate an end of said carcass;

c) said bag having a second closed end formed after the insertion of said bird into said bag; and d) a handle integral said bag at said first closed end, said handle extending side-to-side of said package over and across said bag pocket and being composed of a skirt portion of said congruent front and rear panels extending outwardly from said heat seal in a direction away from said second closed end which skirt portion, upon heat shrinking, draws towards said heat seal and locates over and across said bag pocket.

16. A poultry carcass containing package as in claim 15 wherein said heat seal is contoured to accommodate the shape of said carcass tail portion and said heat seal including linear side portions angled inward from each lateral side edge of said package in a direction away from said second closed end and an arcuate transverse base portion forming a smooth transition from one angled portion to another.

17. A poultry carcass containing package as in claim 16 wherein said second closed end is formed by a heat seal extending along and in general conformity with the profile of said carcass breast portion.

18. A poultry carcass containing package as in claim 15 wherein said transverse heat seal is contoured to accommodate the shape of said carcass breast portion.

19. A poultry carcass containing package as in claim 18 wherein said second closed end comprises a gathered portion of said front and rear panels about said carcass tail portion and a clip engaged about said gathered portion whereby the handle of the bag is adjacent said carcass breast portion.

20. A method of forming a food product containing package with integral carrying handle comprising:

a) providing a bag having congruent front and rear panels of a heat shrinkable thermoplastic film defining the sides of a food product receiving bag pocket, the bag having:

i) a closed bag pocket bottom formed by a transverse heat seal contoured to accommodate an end of a food product inserted into said bag pocket through a bag open end opposite the closed bag pocket bottom, and ii) a skirt at the closed bag pocket bottom being an extension of the congruent front and rear panels from said heat seal, said skirt including a second end of said bag and said skirt having a bag handle forming slit;

b) inserting a food product through said bag open end;

c) evacuating said bag to collapse it about said food product and then effecting an air-tight closure of said bag open end; and then d) heat shrinking said product containing bag to form a taut, generally wrinkle-free package and, responsive to said heat shrinking, a portion of said skirt between said slit and said second end drawing towards said transverse heat seal and locating over and across at least a portion of said bag pocket thereby providing a handle for gripping and lifting said food containing package.

21. A method as in claim 20 wherein said food product is a poultry carcass, and said transverse heat seal is contoured to accommodate the tail end of said carcass, including the steps of:

a) inserting said carcass tail end first through said bag open end;

b) drawing said panels at said open end to substantially a flat width;

c) heat sealing said panels together about the breast end of said carcass to effect said air-tight closure of said open end.

22. A shrink bag with an integral carrying handle-forming portion comprising:

a) congruent generally rectangular front and rear panels of a thermoplastic heat shrinkable material, said panels being superimposed and laying flat one against the other such that opposite first and second ends, and opposite lateral side edges of said panels are common and said panels being joined fluid tight along said opposite lateral side edges;

b) a transverse heat seal joining said panels adjacent but longitudinally spaced from said first end to form a closed fluid tight bag bottom, the second end being open for insertion of an article into said bag;

c) an integral skirt extending along said bag bottom formed by portions of said superimposed front and rear panels between said transverse heat seal and said first end;

d) said skirt having a transverse slit opening through both of said front and rear panels with opposite end portions of said slit being turned in the direction of said second end; and e) a portion of said skirt between said slit and said first end comprising a handle forming portion which, upon heat shrinking said bag about an article sealed in said bag, shrinks towards and draws over said heat seal to form an integral carrying handle for said article-containing bag.

23. A shrink bag as in claim 22 wherein said panels are heat sealed together around the margin of said slit.

24. A shrink bag as in claim 22 having a second transverse heat seal joining said superimposed panels at said first end and said skirt being defined by the portion of said panels between said transverse heat seals.

* * * * *

UNITED STATES PATENT AND TRADEMARK OFFICE

CERTIFICATE OF CORRECTION

PATENT NO. : 5,120,553

DATED : June 9, 1992

INVENTOR(S) : Vytautas Kupcikevicius

It is certified that error appears in the above-identified patent and that said Letters Patent is hereby corrected as shown below:

Col. 2, line 65, after the word "from" insert --a--.

Col. 3, line 34, after the word "end" insert --adjacent but longitudinally spaced from a closed bottom of said bag pocket--.

Col. 3, delete lines 35-51 inclusive i.e., "b) a continuous ...article-containing bag." and insert --b) a first continuous transverse heat seal connecting fluid tight said front and rear panels adjacent to but spaced from said first end, said first heat seal defining the closed bottom of said bag pocket;

c) a skirt formed solely from and defined by said said congruent front and rear panels between said first end and said first transverse heat seal; and d) said skirt having a transverse slit opening through said panels and including a skirt portion between said slit and said first end which upon evacuation of said bag, sealing of said opposite open end and heat shrinking said bag about an article inserted into said bag, draws towards and at least to said transverse first heat seal and forms a bag integral carrying handle for gripping and carrying said article-containing bag.--

Col. 3, line 66, delete "7" and insert --8--.

Col. 7, line 16, after "Skirt" insert --126--.

Col. 7, line 25, delete "6" and insert --8--.

UNITED STATES PATENT AND TRADEMARK OFFICE

CERTIFICATE OF CORRECTION

PATENT NO. : 5,120,553

DATED : June 9, 1992

INVENTOR(S) : Vytautas Kupcikevicius

It is certified that error appears in the above-indentified patent and that said Letters Patent is hereby corrected as shown below:

Col. 8, line 35, in the second instance delete "9" and insert --8--

Signed and Sealed this

Sixteenth Day of November, 1993

Bruce Lehman

*Attest:*

BRUCE LEHMAN

*Attesting Officer*

*Commissioner of Patents and Trademarks*